United States Patent [19]

Katsenes

[11] 4,055,016

[45] Oct. 25, 1977

[54] MODIFIABLE GUN STOCK

[76] Inventor: Philip K. Katsenes, 630 Idaho Ave., Apt. 105, Santa Monica, Calif. 90403

[21] Appl. No.: 709,422

[22] Filed: July 28, 1976

[51] Int. Cl.[2] ..... F41C 23/00

[52] U.S. Cl. ..... 42/71 R; 42/73

[58] Field of Search ..... 42/71 R, 72–74

[56] References Cited

U.S. PATENT DOCUMENTS 2,669,051 2/1954 Cline ..... 42/71 R

FOREIGN PATENT DOCUMENTS 1,170,937 9/1958 France ..... 42/71 R 1,500,181 9/1967 France ..... 42/73

*Primary Examiner*—Charles T. Jordan

[57] ABSTRACT

A gun stock with replaceable comb and butt members anchored to a permanent stock member by means yieldingly urging the butt member into keyed engagement with the stock member to overlie and capture the comb and adapted to be manually released for selective replacement with combs and/or butts of varied configuration, as circumstances require.

9 Claims, 8 Drawing Figures

MODIFIABLE GUN STOCK

BACKGROUND

Sporting guns are made with varied types of stocks to suit the requirements of different personal and shooting situations. Size and shape varies greatly with guns intended for different purposes, and particularly the stocks thereof which are made in a wide variety of configurations in order to adapt the basic gun to the aforesaid personal and shooting requirements. For example; dependent upon the stature and arm length of a person, a suitable gun stock will be longer or shorter from the gun frame to the butt; and dependent upon use, variations in length and configuration will be required. Specifically, it is the extent of the butt and shape of the comb that characterize the changes necessary to adapt a gun to a person and to the use to which the gun is to be employed. It is therefore an object of this invention to provide a gun stock that is adaptable to a person's particular requirements dependent upon both stature and the shooting situations which become involved.

Stocks for rifles and shot guns are made from hardwood and the like, fastened to the frame of the gun near the trigger and extending rearwardly to a butt having a heel and toe portion. Immediately rearward of the frame and trigger, the stock narrows so as to present a grip portion to accommodate the person's trigger hand, most often a downwardly curved grip similar to that of a pistol grip. And characteristically, the stock enlarges in the vertical plane as it extends rearward from said grip portion to present a butt of substantial height and formed to fit into and/or against the person's shoulder. The lower margin of the stock is generally straight as it extends from the grip portion to the toe portion of the butt, while the upper margin or comb is customarily fashioned to the personal and shooting requirements as stated above. Therefore, it is an object of this invention to provide for modification of the controlling gun stock configurations, namely the butt for length and the comb for varied shooting requirements.

Modification of gun stocks has been restricted to singular forms, in that a person's particular needs are fashioned into a stock according to the personal and/or his shooting requirements. Consequently, more than one gun is usually required in order to cope with varied shooting conditions, and to accommodate other persons of different stature. Therefore, a modifiable gun stock is much to be desired and it is the controlling configurations of both the comb and butt that are to be modified. Accordingly, it is an object of this invention to provide for replaceability of both the comb and butt, the former to be held in place by the latter, and all without encumbering the gun stock.

Replaceable parts invariably require some form of fastener and the usual exposure thereof for operability. However, a gun stock must remain unencumbered and devoid of any objectionable features. To this end it is an object of this invention to capture a replaceable upper comb member in position by means of a replaceable rearmost butt member that is manipulatable into and out of working position. With the present invention, the upper comb member slides into working position to be held thereto by means of the rearmost butt member that revolves into a keyed working position overlying the rear of the comb member to secure its placement. It is also an object to provide unique and adaptable mechanisms to releasably attach both the comb member and butt member, all as hereinafter described.

SUMMARY OF THE INVENTION

This invention relates specifically to gun stocks, and especially those for rifles and shot guns. It is modification of the stock configuration which is of primary concern in order to adapt a gun to a person and to the varied shooting requirements that become involved. It is stock length and comb refinements that are to be made, without replacing the entire gun stock; and it is to this end that I provide replaceable comb and butt members C and B that are detachable from the stock S and secured thereto by anchor means A1 and A2 respectively. It is replacement combs C and butts B that are selectively detachable, the comb C being held to its secure working position by the anchor means A1 and the butt B that is manipulated into and out of working position through operation of its anchor means A2. The anchor means A1 and is preferably a hook means. The anchor means A2 yieldingly urges the butt B into keyed alignment with the stock S and comprises a plug P and receptacle R with a spring biased cam means D to urge the butt B into keyed engagement with the stock S and engaged with and to hold the comb C secure in its working position.

DRAWINGS

The various objects and features of this invention will be fully understood from the following detailed description of the typical preferred form and application thereof, throughout which description reference is made to the accompanying drawings, in which.

Figure 3:
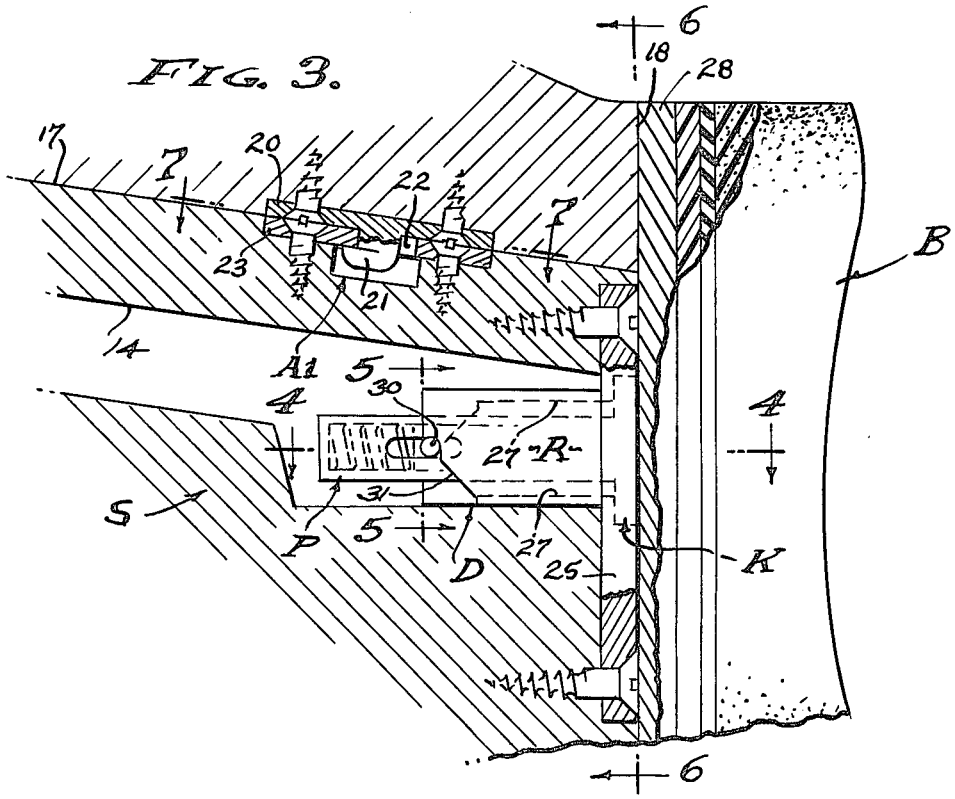
FIG. 3 is an enlarged fragmentary view of a portion of the stock shown in FIG. 1.
Figure 5:
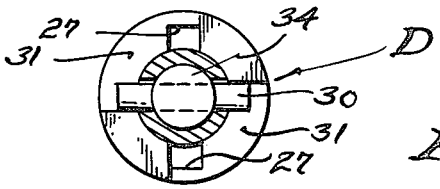
Figure 7:
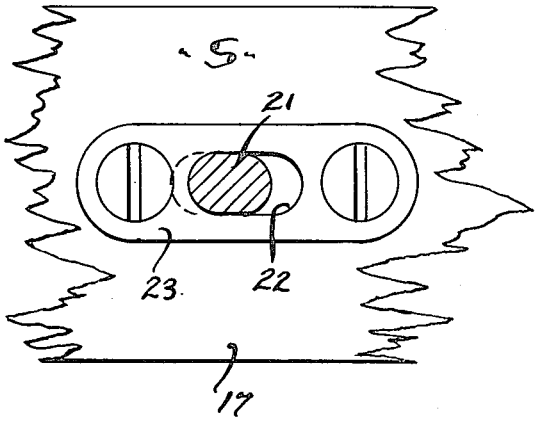
Figure 6:
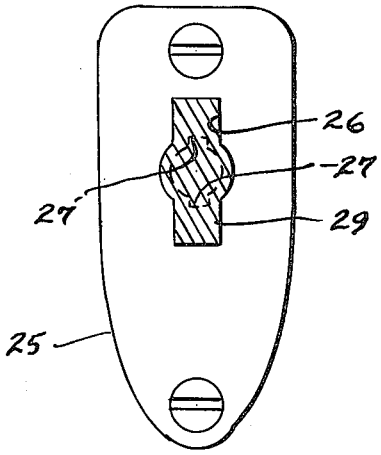

FIGS. 5, 6 and 7 are detailed sectional views taken as indicated by lines 5—5, 6—6, and 7—7 on FIG. 3, respectively.

PREFERRED EMBODIMENT

Referring now to the drawings, the gun is comprised generally of a frame F which carries a barrel 10 and a trigger means 11. A shot gun type firearm is shown, with the trigger means 11 extended rearwardly from a plane of joinder 12 to which the permanent stock member S is attached as by means of a screw 13 applied into the frame through a bore 14 entering through the rear or butt end of the stock. At and/or rearward of the trigger means, the stock member S is narrowed and downwardly curved to form a grip portion 15 and from which the stock S widens in a vertical plane as it extends rearward. In practice, the lower margin 16 of the stock is straight as it extends from the trigger means 11 and/or grip portion 15. However and in accordance with this invention, the upper margin of the stock member S is truncated in a flat transverse plane of joinder 17 extending rearward from the grip portion 15. In practice, the plane 17 is substantially above and parallel to the axis of the access bore 14, the stock S terminating in a transverse end plane 18 to receive the butt member B as will be described The replaceably detachable comb member C is attached to the stock member S at the flat plane of joinder 17, by the anchor means A1. Although the anchor means A1 can vary in form, its function is to detachably place the comb member C in a forward working position where it is to be held by the overlying butt member B. The configurations of the stock and comb members are continued one into the other at the said plane of joinder 17 where the comb member C is adapted to slide upon the stock member S and into a working position related thereto. To this end, spaced hook plates 20 align and engage said members one with the other, preferably forwardly facing hooks 21 depending from the hook plates to engageably slide through longitudinally elongated openings 22 in and to engage beneath anchor plates 23 recessed into the stock member S and exposed at plane 17 to slideably receive said hooks. In practice, the sliding movement is ⅛ inch with accurately formed or tapered hook engagement to assure tightness when forwardly positioned, in which position the comb member C has a transverse end coincidental with the plane 18.

Figure 1:
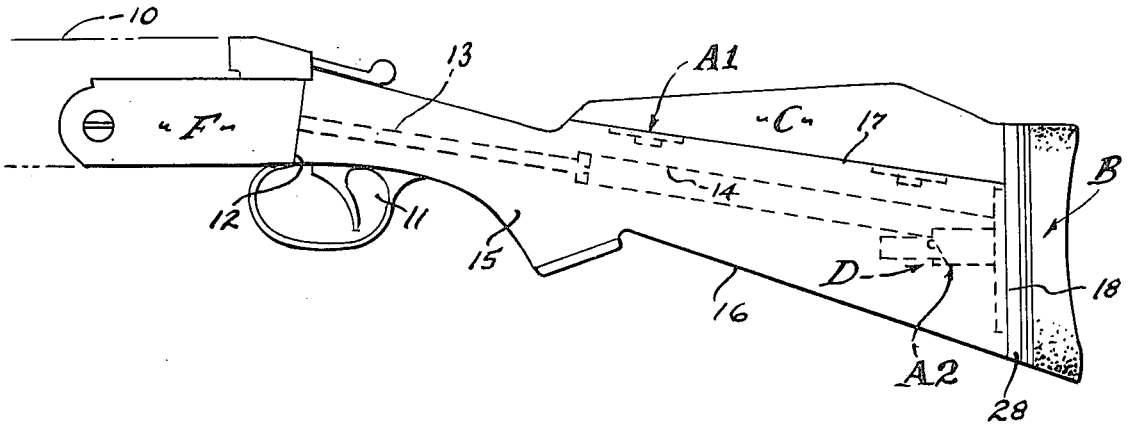
FIG. 1 is a side elevation of a modifiable gun stock embodying the features of the present invention.
Figure 2:
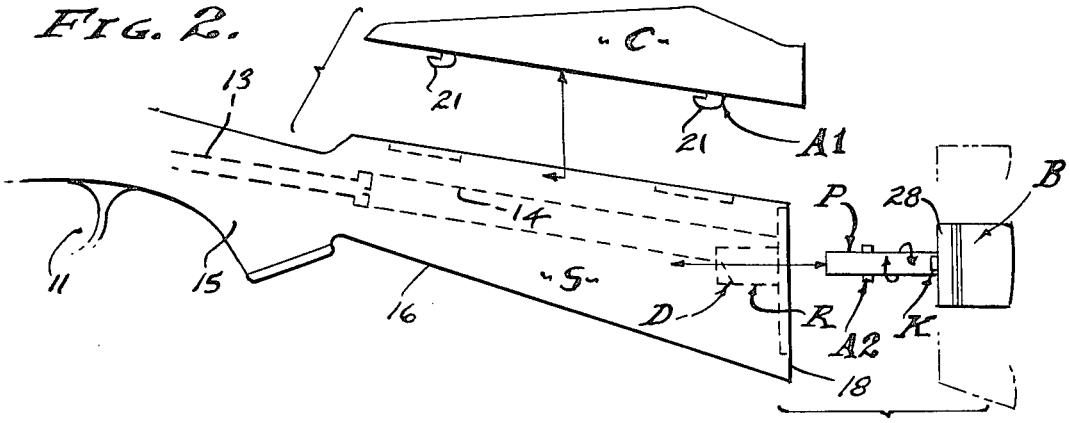
FIG. 2 is a view similar to FIG. 1, exploded to show detachment of the comb and butt members of the stock.
Figure 4:
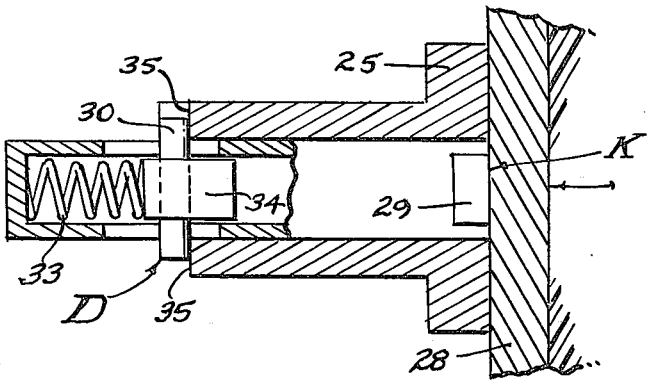
FIG. 4 is a detailed sectional view taken as indicated by line 4—4 on FIG. 3.
Figure 4A:
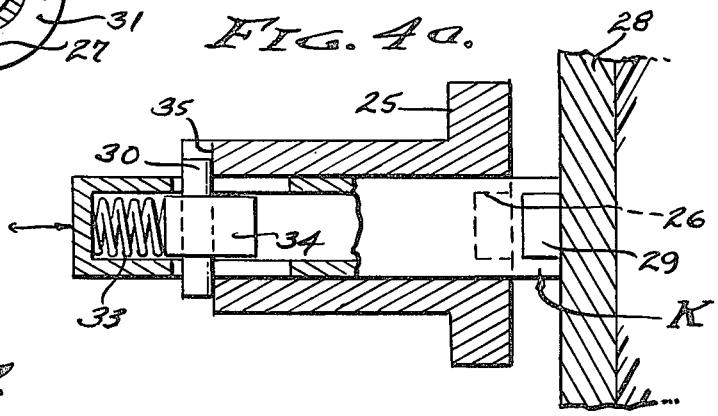
FIG. 4*a* is a view similar to FIG. 4 showing the movement which releases the mechanism.

The replaceably detachable butt member B is attached to the stock member S at the flat plane of joinder 18, by the anchor means A2. In its preferred form the anchor means A2 involves the receptabcle R installed in the stock member S and exposed at the plane 18 for entry of the plug P projecting from the butt member B. The plug P is disposed on the axis of rotation normal to the plane of joinder 18 where the butt and stock members rotatably slide into and out of alignment. The cam means D is spring biased to apply coupling pressure (compare FIGS. 4 and 4*a*) between the plug P and receptacle R adapted to be forceably disengaged axially for rotation (see FIG. 2), there being a key means K cooperatively related thereto for release of the butt member B by means of its rotation relative to the stock member S. The configuration one into the other at the said plane of joinder 18 where the butt member B is adapted to turn with respect to the stock member S.

The receptacle R is a cylinder that enters the bore 14 or similar recess in the stock member S, and in practice is secured to the stock by a mounting plate 25 in which there is a recess 26 of the key means K. A guideway 27 is internally coextensive with the bore open rearwardly to slidably receive the plug P that extends from a butt plate 28 on which there is a lug 29 of key means K. A feature of the invention is the cam means D the co-acts between the receptacle R and plug P to yieldingly urge the latter forwardly into keyed engagement with the former. Accordingly, the guideway 27 is a straight slot or channel that slideably receives a rearwardly biased pin 30 that projects laterally from the plug to engage a forwardly pitched helical cam face 31 at the forward end of the receptacle. In practice, the pin 30 is double ended to project from opposite sides of the plug P, and engageable in diametrically opposite channels or guideways 27 which open into complementary cam faces 31. As shown, a spring 33 depresses the pin 30 rearwardly in a confining slot that limits its travel, and so as to project from a retaining plug or follower 34 permitting the pin 30 to ride up the helix of face or faces 31 and onto a land 35 when the butt and stock members are aligned; and in which position the lug 29 of key means K drops into the recess 26 therefor (see FIG. 4). Reversely, the butt member B is lifted axially (rearwardly — see FIG. 4*a*) from the stock member S and rotated (see FIG. 2) for retraction of pin 30 through the guideway 27.

From the foregoing it will be seen that the comb member C and butt member B are replaceable in kind, with members of selectively different configuration. There are no external features to encumber the gun stock, and replacement is effected by simply pulling the butt member B axially rearward for disengagement of the key means K, followed by backward rotation of the butt member for alignment of pin 30 with guideway 27 which permits freedom for retraction. An opposite procedure is followed for assembly.

Having described only a typical preferred form and application of my invention, I do not wish to be limited or restricted to the specific details herein set forth, but wish the reserve to myself any modifications or variations that may appear to those skilled in the art:

I claim:

1. A modifiable gun stock comprised of a permanent stock member and replaceable comb and butt members, the comb member being releasably secured in position to the stock member by anchor means, and the butt member being releasably secured to the stock member by anchor means comprisng relatively rotatable plug and receptable means with a cam helix biasing a spring to forwardly couple the butt member into keyed engagement with the stock member to overlie and capture the comb member in its secured position.

2. The modifiable gun stock as set forth in claim 1, wherein the butt member is separable from the stock member and comb member along a transversely disposed plane of joinder.

3. The modifiable gun stock as set forth in claim 1, wherein the cam helix biasing a spring forwardly urges the butt member into keyed and thereby couples the butt member into said keyed engagement with both the stock member and comb member.

4. A modifiable gun stock comprised of a permanent stock member and replaceable comb and butt members, and including; an anchor means replaceably securing the comb member in position to the stock member, and anchor means replaceably securing the butt member in position to the stock member to overlie a portion of the comb member for its capture, the butt member being urged in to retractable engagement with key means by cam means depressing a spring in positioning the butt member in working position to the stock member.

5. The modifiable gun stock as set forth in claim 4, wherein the butt member anchor means is comprised of a plug projecting from the butt member, and a receptable recessed in the stock member, the said plug being releasably engaged in the said receptable.

6. The modifiable gun stock as set forth in claim 4, wherein the butt member anchor means is comprised of a plug projecting from the butt member and with a cam following pin pressed rearwardly by said spring, and a receptacle recessed in the stock member and with a cam face forwardly to engage said pin, there being a guideway within the receptacle to pass the pin.

7. The modifiable gun stock as set forth in claim 4, wherein the butt member anchor means is comprised of relatively rotatable plug and receptacle means, the plug projecting from the butt member and with a spring biased cam following pin restricted to a longitudinal slot therein, and the receptacle recessed in the stock member and with a helical cam faced forwardly to engage said pin for depressing the same to yieldingly urge the butt member forwardly so as to engage the stock member and capture the said comb member.

8. The modifiable gun stock as set forth in claim 4, wherein the butt member is separable from the stock member and comb member along a transversely disposed plane of joinder, and wherein the butt member anchor means is comprised of a plug rotatable on an axis normal to said transverse plane of joinder, the plug projecting from the butt member on said axis and with a spring biased cam following pin restricted to a horizontal slot therein, and a receptacle recessed in the stock member and with a helical cam on said axis and faced fowardly to engage said pin for depressing the same to yieldingly urge the butt member forwardly so as to engage the stock member and capture the said comb member.

9. The modifiable gun stock as set forth in claim 4, wherein the butt member is separable from the stock member and comb member along a transversely disposed plane of joinder, and wherein the butt member anchor means is comprised of a plug rotatable on an axis normal to said transverse plane of joinder, the plug projecting from the butt member on said axis and with a spring biased cam following pin restricted to a horizontal slot therein, and a receptacle recessed in the stock member and with a helical cam on said axis and faced forwardly to engage said pin for depressing the same to yieldingly urge the butt member forwardly so as to engage the said key means on the stock member and capture the said comb member.

* * * * *